US010550663B2

(12) United States Patent
Doherty

(10) Patent No.: US 10,550,663 B2
(45) Date of Patent: Feb. 4, 2020

(54) METHODS, SYSTEMS, AND DEVICES FOR SEALING STAGE TOOL LEAKS WITH MELTABLE ALLOY

(71) Applicant: CONOCOPHILLIPS COMPANY, Houston, TX (US)

(72) Inventor: Dale R. Doherty, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 16/021,916

(22) Filed: Jun. 28, 2018

(65) Prior Publication Data

US 2019/0003282 A1 Jan. 3, 2019

Related U.S. Application Data

(60) Provisional application No. 62/526,708, filed on Jun. 29, 2017.

(51) Int. Cl.

| | |
|---|---|
| ***E21B 33/14*** | (2006.01) |
| ***E21B 34/14*** | (2006.01) |
| ***E21B 33/10*** | (2006.01) |
| *E21B 33/16* | (2006.01) |

(52) U.S. Cl.
CPC ..... *E21B 33/146* (2013.01); *E21B 34/14* (2013.01); *E21B 33/16* (2013.01)

(58) Field of Classification Search
CPC ..... E21B 33/146; E21B 33/10; E21B 34/14; E21B 33/16
See application file for complete search history.

(56) References Cited

U.S. PATENT DOCUMENTS

| | | | | |
|---|---|---|---|---|
| 1,912,578 | A * | 6/1933 | Halliburton | E21B 33/146 166/154 |
| 3,578,084 | A * | 5/1971 | Bombardieri | E21B 17/1028 166/241.6 |
| 5,479,986 | A | 1/1996 | Gano et al. | |
| 6,474,414 | B1 * | 11/2002 | Gonzalez | E21B 33/14 166/192 |
| 7,857,052 | B2 | 12/2010 | Giroux et al. | |
| 9,447,655 | B2 * | 9/2016 | Zhao | E21B 33/04 |
| 2003/0098064 | A1 | 5/2003 | Kohli et al. | |
| 2015/0021026 | A1 * | 1/2015 | Giroux | E21B 33/146 166/289 |
| 2015/0101813 | A1 * | 4/2015 | Zhao | E21B 33/04 166/302 |
| 2015/0368542 | A1 * | 12/2015 | Carragher | E21B 33/134 166/288 |
| 2016/0145962 | A1 | 5/2016 | Carragher | |

OTHER PUBLICATIONS

International Search Report and Written Opinion received in PCT Application No. PCT/US2018/040048 dated Sep. 20, 2018.

* cited by examiner

*Primary Examiner* — William D Hutton, Jr.
*Assistant Examiner* — Crystal J Miller
(74) *Attorney, Agent, or Firm* — Boulware & Valoir

(57) ABSTRACT

Methods, systems, and devices for sealing stage tool leaks are disclosed. In one aspect a stage tool for wellbore cementing comprises an external stage tool body and a sliding sleeve within the external stage tool body configured to regulate cement flow through the stage tool. At least a portion of the sliding sleeve comprises a meltable alloy configured to seal a leak. The meltable alloy is configured to be melted by a heating source, flow into the leak, and resolidify as the melted alloy cools, thereby sealing the leak.

18 Claims, 4 Drawing Sheets

METHODS, SYSTEMS, AND DEVICES FOR SEALING STAGE TOOL LEAKS WITH MELTABLE ALLOY

CROSS-REFERENCE TO RELATED APPLICATIONS

None. This application is a non-provisional application which claims benefit under 35 USC § 119(e) to U.S. Provisional Application Ser. No. 62/526,708 filed Jun. 29, 2017, entitled "METHODS, SYSTEMS, AND DEVICES FOR SEALING STAGE TOOL LEAKS," which is incorporated herein in its entirety.

STATEMENT REGARDING FEDERALLY SPONSORED RESEARCH

None.

BACKGROUND OF THE INVENTION

The present disclosure generally relates to a stage tool for cementing a wellbore, and in particular systems and methods for sealing stage tool leaks.

The stage tools find its application in conventional and non-conventional wells to enable cementing long columns in two or several stages. Generally, while using cementing tools involving two stages, the tool is placed in the casing string so that the hydrostatic pressure of the cement column does not break down the formation. After the completion of first stage cementation and when the cement has gained enough strength to support hydrostatic pressure, the stage tool is opened and the cement job is performed on the upper half of the well. Many natural terrains require the aforementioned stage tool for successful cementing.

A challenge with conventional stage tools for wellbore cementing is that the sleeves that isolate the inner casing from the annulus, once closed, may leak. This may lead to leakage of wellbore fluids and hydrocarbons to the inside of the casing, requiring remediation and increasing the cost.

A conventional method to prevent leaking involves a cement squeeze. However, the method of cement squeezing does not have a high success rate due to the high pressure exerted at the wellbores on the set cement. Another conventional method of leak protection involves a casing patch. A casing patch requires a rig which may be expensive. Yet another conventional method of sealing uses a stub liner, which increases the complexity of the tool and also increases the cost of production. Therefore, there exists the need for improved devices, methods, and systems for sealing stage tool leaks.

SUMMARY OF THE INVENTION

In one aspect, the present application discloses methods, systems, and devices for sealing stage tool leaks. In one embodiment a stage tool for wellbore cementing, comprises an external stage tool body; and a sliding sleeve within the external stage tool body configured to regulate cement flow through the stage tool. The sliding sleeve may comprise a meltable alloy configured to seal a leak. The meltable alloy is configured to be melted by a heating source, flow into the leak, and resolidify as the melted alloy cools, thereby sealing the leak. In an embodiment, the meltable alloy is a bismuth-containing alloy. The bismuth-containing alloy may comprise germanium. Additionally or alternatively, the bismuth-containing alloy may comprise copper, lead, tin, cadmium, indium, antimony, gallium, antimony, or silver. In an embodiment, the meltable alloy is a solder. The meltable alloy may be a eutectic alloy. In an embodiment, the heating source is a thermite heater. The heating source may comprise a damping agent. In various embodiments, the external stage tool body comprises a body cement port and the sliding sleeve comprises a sleeve cement port. The sliding sleeve may be configured to have a closed configuration wherein the body cement port and the sleeve cement port are not aligned and an open configuration wherein the body cement port and the sleeve cement port are aligned. In an embodiment, the external stage tool body comprises a backstop positioned to shield the body cement port and prevent cooled alloy from blowing out of the body cement port during pressure testing. The sliding sleeve may have an aluminum backing on an inner side configured to restrain the melted alloy from flowing into an inside of the tool. The aluminum backing may be configured to guide the melted alloy through the sleeve cement port and the body cement port to a backstop on the external stage tool body.

In an aspect, a method of sealing a leak in a stage tool, comprises delivering a heating source to a stage tool having a leak, melting a portion of the sliding sleeve using the heating source, causing the melted alloy to flow into the leak, and resolidifying the alloy thereby sealing the leak. The stage tool comprises a sliding sleeve configured to be opened exposing cement ports that regulate cement flow through the stage tool, additionally after cementation the sleeve closes and is intended to seal the ports. The melted portion of the sliding sleeve comprises a meltable alloy configured to seal the leak. In an embodiment, the meltable alloy is a bismuth-containing alloy. The bismuth-containing alloy may comprise germanium. In an embodiment, the heating source is a thermite heater. The heating source may comprise a damping agent. The method may further comprise guiding the melted alloy to the location of the leak and confining the molted alloy at the location of the leak using a backing sleeve or a backstop fixture.

This, and further aspects of the present embodiments are set forth herein.

BRIEF DESCRIPTION OF THE DRAWINGS

The invention has other advantages and features which will be more readily apparent from the following detailed description of the invention and the appended claims, when taken in conjunction with the accompanying drawings, in which:

DETAILED DESCRIPTION

Figure 1:
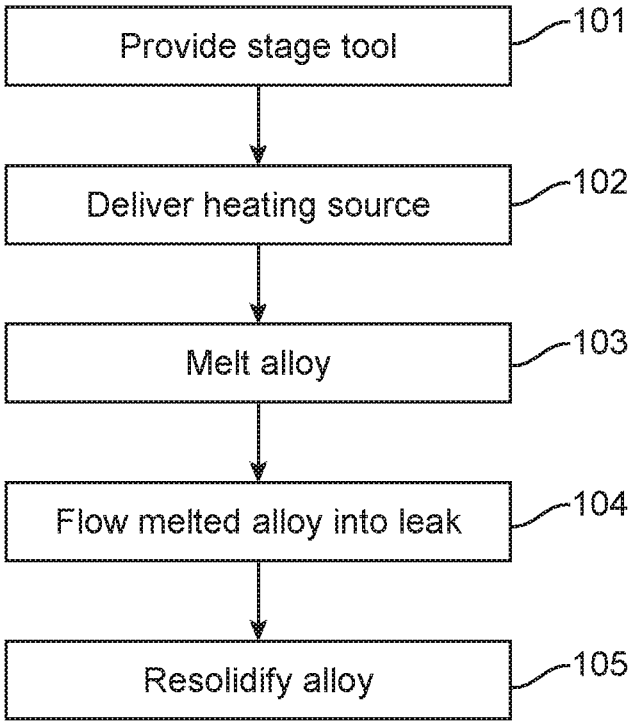
FIG. 1 shows an exemplary method for sealing leaks in a stage tool.

While the invention has been disclosed with reference to certain embodiments, it will be understood by those skilled in the art that various changes may be made and equivalents may be substituted without departing from the scope of the invention. In addition, many modifications may be made to adapt to a particular situation or material to the teachings of the invention without departing from its scope.

Throughout the specification and claims, the following terms take the meanings explicitly associated herein unless the context clearly dictates otherwise. The meaning of "a", "an", and "the" include plural references. The meaning of "in" includes "in" and "on." Referring to the drawings, like numbers indicate like parts throughout the views. Additionally, a reference to the singular includes a reference to the plural unless otherwise stated or inconsistent with the disclosure herein.

The word "exemplary" is used herein to mean "serving as an example, instance, or illustration." Any implementation described herein as "exemplary" is not necessarily to be construed as advantageous over other implementations.

FIG. 1 shows an exemplary method for sealing leaks in a stage tool. At step 101 the stage tool is provided. Examples of stage tools are described in U.S. Pat. No. 7,857,052, which is herein incorporated by reference in its entirety. The stage tool may then be used for wellbore cementing. An exemplary stage tool configured to seal leaks is shown in FIG. 2.

In an embodiment the stage tool 200 comprises a tubular external stage tool body 201 with one or more body cement ports 203 configured to deliver cement to the wellbore. The stage tool 200 may further comprise a tubular sliding sleeve 202 within the external body 201 configured to regulate cement flow through the stage tool 200. The sliding sleeve 202 comprises one or more body cement ports 204 configured to deliver cement to the wellbore. The stage tool 200 may have a sliding sleeve, a rotational open-close sleeve, and/or an electronic, mechanical or hydraulic tool.

The stage tool 200 may have closed and open configurations. In various embodiments, stage tool 200 may be opened or closed by free-fall dropping plugs. Alternatively, stage tool 200 may be opened or closed hydraulically. In an embodiment, the sliding sleeve 202 is configured to longitudinally slide within the external body 201 to move between the closed and open configurations. In the closed configuration, the sleeve cement ports 204 are longitudinally misaligned with the body cement ports 203, thereby preventing cement flow to the wellbore. The sliding sleeve 202 may longitudinally slide within the external body 201 to align the sleeve cement ports 204 with the body cement ports 203 thereby allowing the cement to be delivered to the wellbore.

Figure 2:
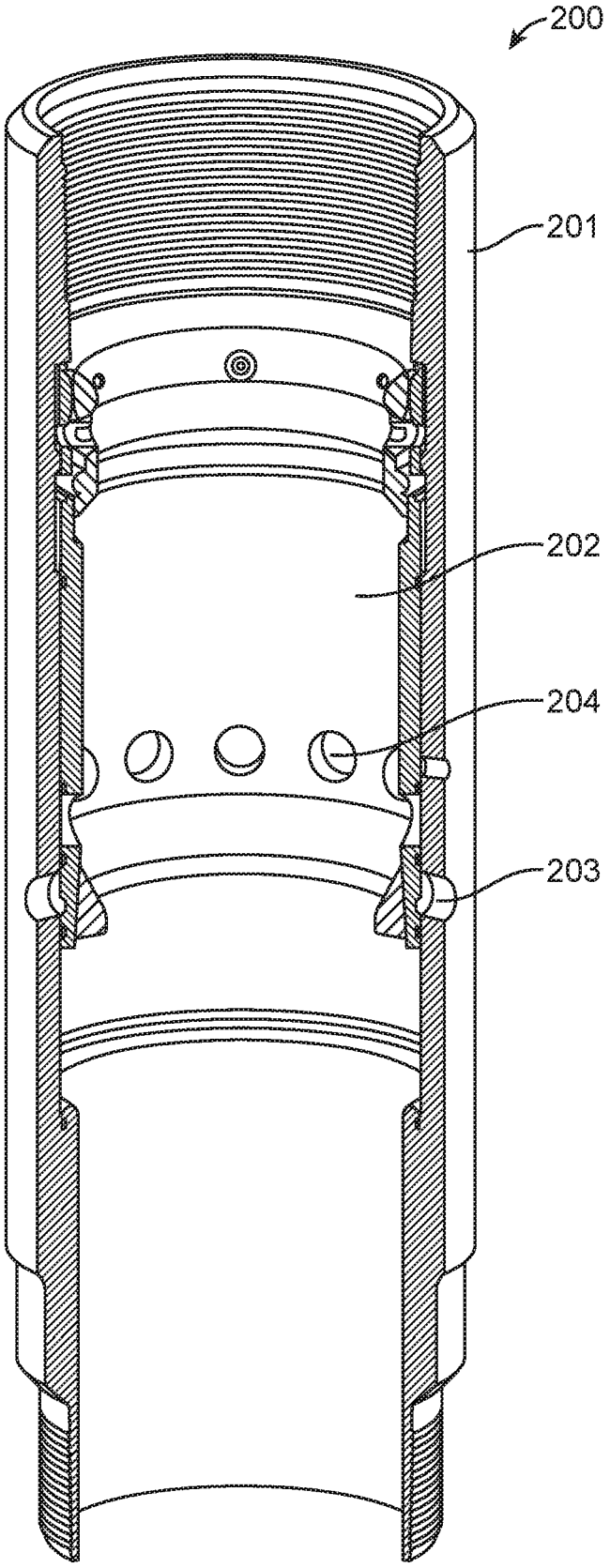
FIG. 2 shows an embodiment of a stage tool configured to seal leaks.

While FIG. 2 depicts a stage tool with a longitudinally sliding sleeve, other configurations may be used. In an alternative embodiment the stage tool may comprise a rotating sleeve or collar configured to transition the stage tool between open and closed configurations. In the closed configuration, the sleeve cement ports are circumferentially misaligned with the body cement ports, thereby preventing cement flow to the wellbore. The rotating sleeve may rotate within the external body to align the sleeve cement ports with the body cement ports thereby allowing the cement to be delivered to the wellbore. In other embodiments, the stage tool may be opened or closed using electronic, mechanical, or hydraulic mechanisms.

All or part of sliding sleeve 202 of the stage tool 200 may comprise a meltable alloy configured to seal a leak. In various embodiments the meltable alloy may be a solder. In some embodiments the meltable alloy is a eutectic alloy. In an embodiment the meltable alloy is a bismuth containing alloy. The bismuth containing alloy may comprise additional metals such as germanium in order to regulate the melting temperature to a higher or lower value. Additionally or alternatively the bismuth alloy may comprise other metals such as copper, lead, tin, cadmium, indium, antimony, gallium, antimony, or silver. The proportions of bismuth and other materials in the alloy may be adjusted to reach a desired melting temperature and/or durability. For example, a bismuth alloy with a germanium percentage of less than 1% by weight increases the melting temperature to approximately 550° C. from 271° C. for pure bismuth. A bismuth alloy with a germanium percentage of 10% by weight increases the melting temperature to approximately 740° C. In an embodiment, the meltable alloy is a bismuth alloy with up to 20% germanium by weight, since the melting temperature of the alloy is minimally affected by increasing the percentage of germanium above 20%.

If a leak is detected, at step 102 a heating source is delivered to a portion of the sliding sleeve comprising the meltable alloy and near the leak. The heating source may be any source capable of generating enough heat to melt the meltable alloy such as a chemical or electrical heater. In an embodiment, the heating source is a thermite heater. The thermite in various embodiments is selected from a mixture comprising aluminium, magnesium, titanium, zinc, silicon, or boron with oxidizers such as bismuth(III) oxide, boron (III) oxide, silicon(IV) oxide, chromium(III) oxide, manganese(IV) oxide, iron(III) oxide, iron(II,III) oxide, copper(II) oxide or lead(II,IV) oxide. A thermite with the combination of aluminium and iron oxide may be used. Thermite may be mixed with a damping agent such as sand or silica in order to reduce the temperature of the reaction. The proportions of thermite and damping agent in the heating source may be adjusted to reach a desired reaction temperature compatible with the melting temperatures of the meltable alloy and other materials in the stage tool. Thermite proportions may range from 100% to less than 1%, with the damping agent comprising the remainder of the thermite mixture. For example, the heating source may be configured to reach a temperature sufficient to melt the meltable alloy but not high enough to melt other portions of the stage tool made of materials such as aluminum, steel, etc. Examples of heating sources and meltable alloys are described in U.S. Pat. Pub. No. 20150368542, which is herein incorporated by reference in its entirety.

At step 103 the heating source is activated. The heating source then heats to a sufficient temperature to melt at least a portion of the meltable alloy. The sliding sleeve 202 may further comprise an aluminum backing on an inner side configured to restrain the melted alloy from flowing into an inside of the tool. At step 104 the melted alloy flows into the leak.

At step 105 the heating source is removed, deactivated, or the chemical reaction is allowed to complete. The melted alloy is then allowed to cool. The melted alloy then resolidifies, thereby sealing the leak.

Figure 3A:
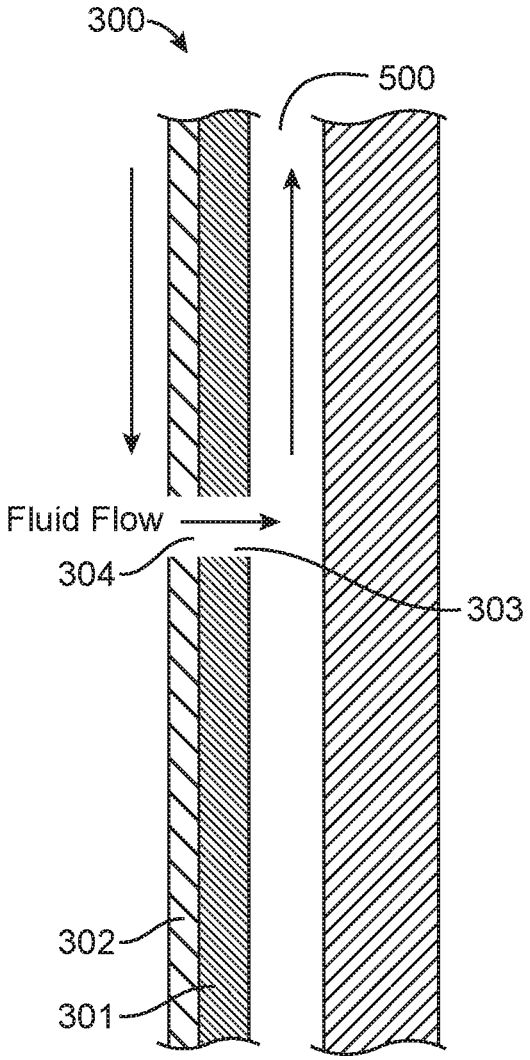
FIGS. 3A-3C show exemplary embodiments of stage tools within a wellbore.

FIG. 3A shows a partial cross-section of an exemplary embodiment of a stage tool within a wellbore. Stage tool 300 is placed within wellbore 500. The sliding sleeve 302 is held within the external body 301. The stage tool is shown in an open configuration with the body cement ports 303 and sleeve cement ports 304 aligned. The arrows depict the direction of fluid flow.

Figure 3B:
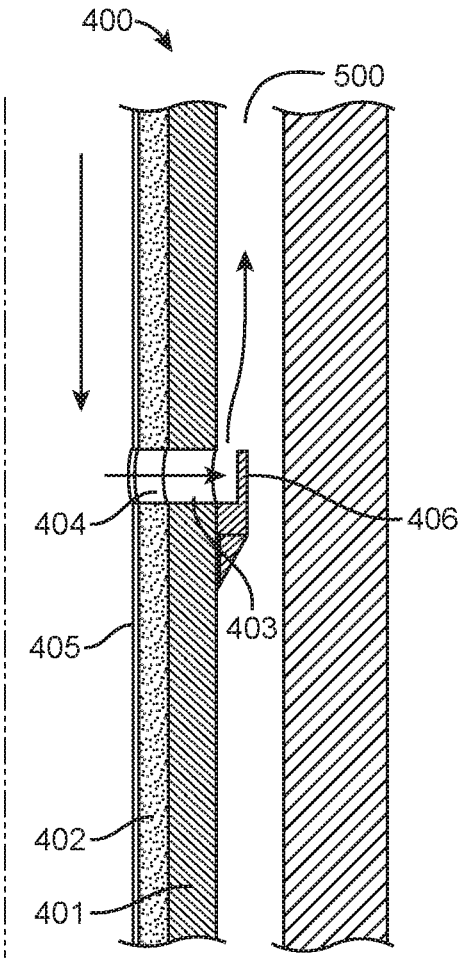
Figure 3C:
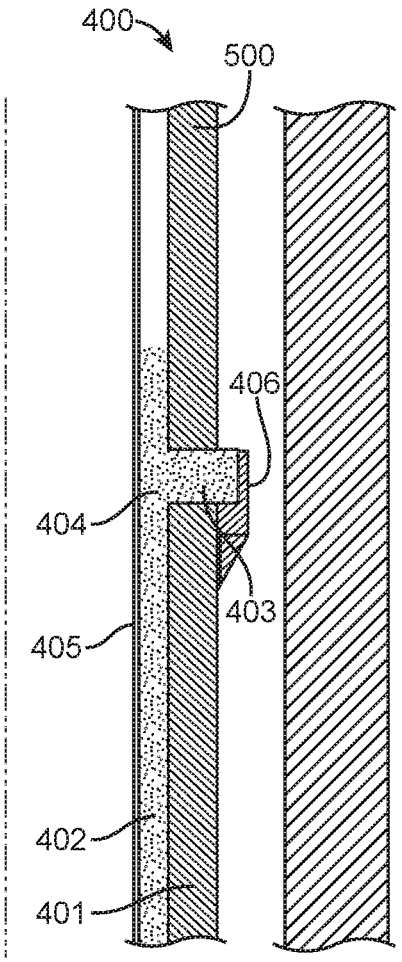

FIGS. 3B and 3C show a partial cross-section of embodiment of a stage tool having a sleeve backing and a body backstop. Stage tool 400 is shown within wellbore 500. The sliding sleeve 402 is held within the external body 401. The stage tool 400 is shown in an open configuration with the body cement ports 403 and sleeve cement ports 404 aligned. The arrows depict the direction of fluid flow. The sliding sleeve 402 comprises a thin sleeve backing 405 on the inner side to restrain the alloy from running into the inside of the inner lumen of the tool 400. The backing 405 may be made of aluminum or other materials having a melting point higher than the meltable alloy. The backing 405 would thus guide the melted alloy to the desired location.

In the event that the stage tool 400 did not close, it would leave a number of the circulation ports open. Open ports may not always get sealed by cement after the stage tool 400 is drilled out. The exterior of the external body 401 of the stage tool 400 may comprise a backstop 406 positioned to shield the body cement port 403. The backstop 406 would prevent cooled alloy in the cement ports 403, 404 from being blown out of the cement ports 403, 404 during the pressure testing. FIG. 3B depicts the stage tool 400 before the meltable alloy is melted by the heat source. FIG. 3C depicts the stage tool 400 after the alloy has been melted by the heat source. The backing 405 guides the melted alloy to the cement ports 403, 404 where it is held in place by the backstop 406.

Although the detailed description contains many specifics, these should not be construed as limiting the scope of the invention but merely as illustrating different examples and aspects of the invention. It should be appreciated that the scope of the invention includes other embodiments not discussed herein. Various other modifications, changes and variations which will be apparent to those skilled in the art may be made in the arrangement, operation and details of the system and method of the present invention disclosed herein without departing from the spirit and scope of the invention as described here.

While the invention has been disclosed with reference to certain embodiments, it will be understood by those skilled in the art that various changes may be made and equivalents may be substituted without departing from the scope of the invention. In addition, many modifications may be made to adapt to a particular situation or material the teachings of the invention without departing from its scope.

What is claimed is:

1. A stage tool for wellbore cementing, comprising:

an external stage tool body; and a sliding sleeve within the external stage tool body configured to regulate cement flow through the stage tool;

wherein the external stage tool body comprises a body cement port; and the sliding sleeve comprises a sleeve cement port;

wherein the sliding sleeve is configured to have a closed configuration wherein the body cement port and the sleeve cement port are not aligned, and an open configuration wherein the body cement port and the sleeve cement port are aligned to allow cement flow to a wellbore;

wherein the sliding sleeve comprises a meltable alloy configured to seal a leak; and wherein the meltable alloy is configured to be melted by a heating source, flow into the leak, and resolidify as the melted alloy cools, thereby sealing the leak.

2. The stage tool of claim 1, wherein the meltable alloy is a bismuth-containing alloy.

3. The stage tool of claim 2, wherein the bismuth-containing alloy comprises germanium.

4. The stage tool of claim 3, wherein the bismuth-containing alloy further comprises copper, lead, tin, cadmium, indium, antimony, gallium, or silver.

5. The stage tool of claim 1, wherein the meltable alloy is a solder.

6. The stage tool of claim 1, wherein the meltable alloy is a eutectic alloy.

7. The stage tool of claim 1, wherein the heating source is a thermite heater.

8. The stage tool of claim 1, wherein the thermite heater comprises a damping agent.

9. The stage tool of claim 1, wherein the sliding sleeve is configured for longitudinal sliding from said closed configuration to said open configuration.

10. The stage tool of claim 1, wherein the external stage tool body comprises a backstop positioned to shield the body cement port and prevent cooled alloy from blowing out of the body cement port during pressure testing.

11. The stage tool of claim 1, wherein the sliding sleeve has an aluminum backing on an inner side configured to restrain the melted alloy from flowing into an inside of the stage tool.

12. The stage tool of claim 11, wherein the aluminum backing is configured to guide the melted alloy through the sleeve cement port and the body cement port to a backstop on the external stage tool body.

13. A method of sealing a leak in a stage tool, comprising:

delivering a heating source to the stage tool of claim 1 having a leak;

melting a portion of the sliding sleeve using the heating source to form melted alloy;

causing the melted alloy to flow into the leak; and resolidifying the melted alloy thereby sealing the leak.

14. The method of claim 13, wherein the meltable alloy is a bismuth-containing alloy.

15. The method of claim 14, wherein the bismuth-containing alloy comprises germanium.

16. The method of claim 13, wherein the heating source is a thermite heater.

17. The method of claim 16, wherein the thermite heater comprises a damping agent.

18. The method of claim 13, further comprising guiding the melted alloy to the location of the leak and confining the melted alloy at the location of the leak using a backing sleeve or a backstop fixture.

* * * * *